US008220470B2

(12) United States Patent
Hicks

(10) Patent No.: US 8,220,470 B2
(45) Date of Patent: Jul. 17, 2012

(54) FURNITURE PAD FOLDING MACHINE

(76) Inventor: Jessie Lee Hicks, San Fernando, CA (US)

( * ) Notice: Subject to any disclaimer, the term of this patent is extended or adjusted under 35 U.S.C. 154(b) by 423 days.

(21) Appl. No.: 12/148,260

(22) Filed: Sep. 15, 2008

(65) Prior Publication Data

US 2010/0064735 A1 Mar. 18, 2010

(51) Int. Cl.

| | |
|---|---|
| ***A61L 2/00*** | (2006.01) |
| ***A61L 9/00*** | (2006.01) |
| ***D06M 11/38*** | (2006.01) |
| ***D06P 7/00*** | (2006.01) |
| ***B08B 3/12*** | (2006.01) |
| ***B08B 3/00*** | (2006.01) |
| ***D06F 31/00*** | (2006.01) |
| ***D06F 58/00*** | (2006.01) |
| ***F26B 11/02*** | (2006.01) |

(52) U.S. Cl. ..... 134/61; 422/292; 422/300; 422/301; 422/302; 422/305; 422/307; 8/159; 8/134 R; 8/178; 8/179; 8/469; 8/150; 8/152; 8/125; 8/500; 8/137; 68/4; 68/5 R; 68/11; 134/84; 134/95.2; 134/172; 134/198; 34/108; 34/109; 34/130; 34/596

(58) Field of Classification Search ..... 422/292, 422/300, 301, 302, 305, 307; 8/159, 134 R, 8/178–179, 469, 150, 152, 125, 500, 137; 68/4, 5 R, 11; 134/61, 84, 95.2, 172, 198; 34/108–109, 130, 596

See application file for complete search history.

(56) References Cited

U.S. PATENT DOCUMENTS 4,323,359 A * 4/1982 Keller ..... 8/155
5,715,555 A * 2/1998 Reber et al. ..... 8/158

* cited by examiner

*Primary Examiner* — Jill Warden
*Assistant Examiner* — Monzer Chorbaji
(74) *Attorney, Agent, or Firm* — Michael D. Eisenberg

(57) ABSTRACT

The Furniture Pad Folding Machine is a dry cleaning machine that is multi-faceted; it can clean and disinfect furniture pads and the machine has the ability to fold furniture pads. The machine is portable and can function on the moving truck and at the warehouse.

3 Claims, 11 Drawing Sheets

FURNITURE PAD FOLDING MACHINE

CROSS REFERENCE TO RELATED APPLICATIONS

This application claims the benefits of provisional patent application Ser. No. 60/923,619, filed 2007 Apr. 14 by the present inventor.

FEDERALLY SPONSORED RESEARCH OR DEVELOPMENT

Not Applicable

SEQUENCE LISTING OR PROGRAM

Not Applicable

BACKGROUND-FIELD OF INVENTION

This invention relates to disinfecting and folding furniture pads in the moving industry.

BACKGROUND-PRIOR ART

Professional moving companies commonly supply their own moving pads. Often the pads are not cleaned and are re-used from one household to another. There has been two machines that were designed to simply fold laundry; U.S. Pat. No. 3,899,166 to Behn (1973) and U.S. Pat. No. 4,234,1799 to Weir 1979. There has been a machine that was designed to fold clothing; U.S. Pat. No. 4,601,695 to Pazzi 1984. There was one designed to wash, dry, and fold using water; U.S. Pat. No. 5,715,555 to Reber, Stuckman, & Perttunen 1995. However, none of these provides the unique services that the Furniture Pad Folding Machine provides. The Furniture Pad Folding Machine folds and disinfects moving pads, while safeguarding the moving industry from spreading germs from family to family. The Furniture Pad Folding Machine is portable, electric, doesn't use water, and saves manpower hours, because there are 3 hundred to 4 hundred pads on each truck that must be folded between each job.

SUMMARY

The Furniture Pad Folding Machine will prevent the spread of the germs and reduce the need for additional manpower hours for folding the furniture pads. It is portable, light weight, and electrical so it can be easily carried on the truck.

DRAWINGS—FIGURES

Detailed Description

Figure 1:
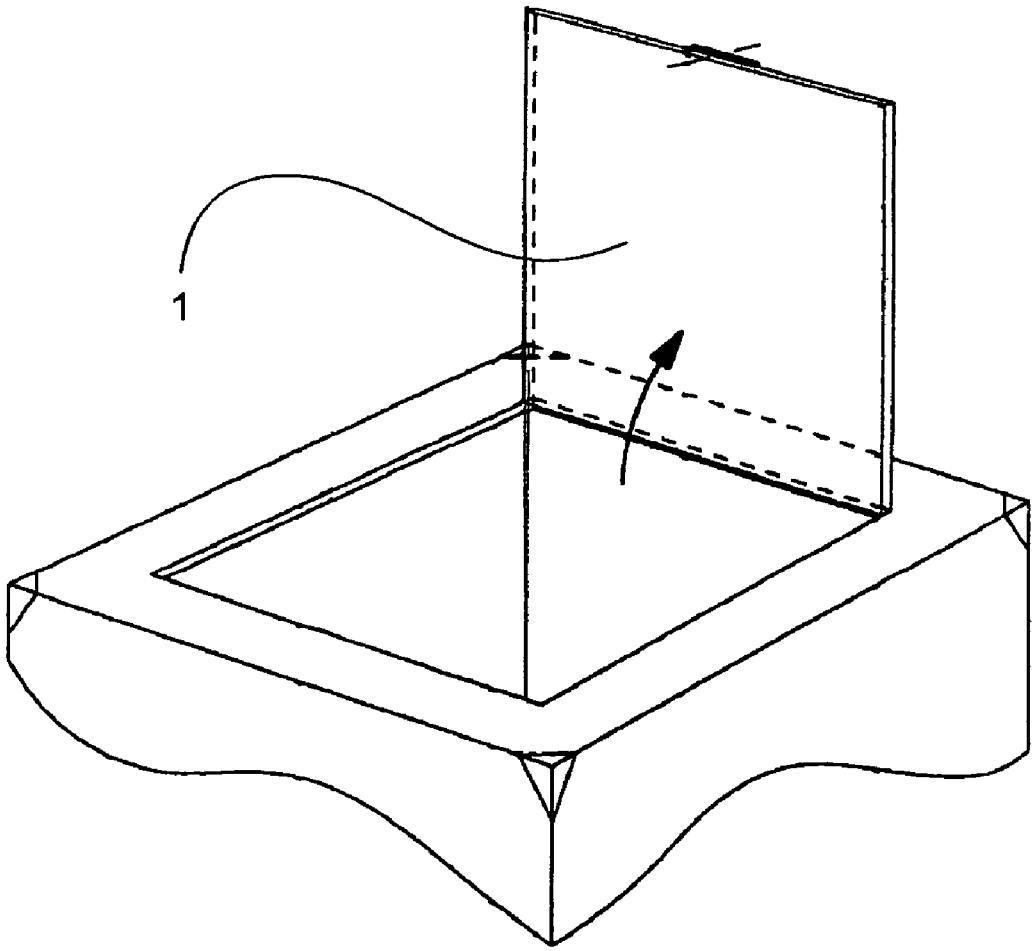
Figure 2:
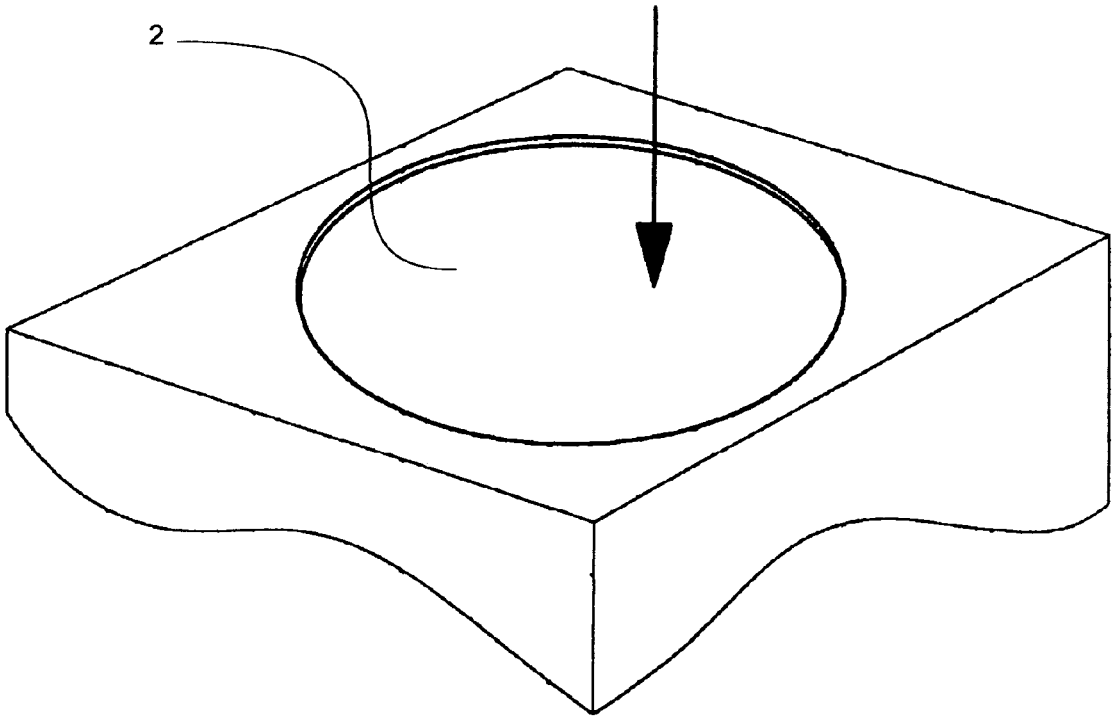
Figure 3:
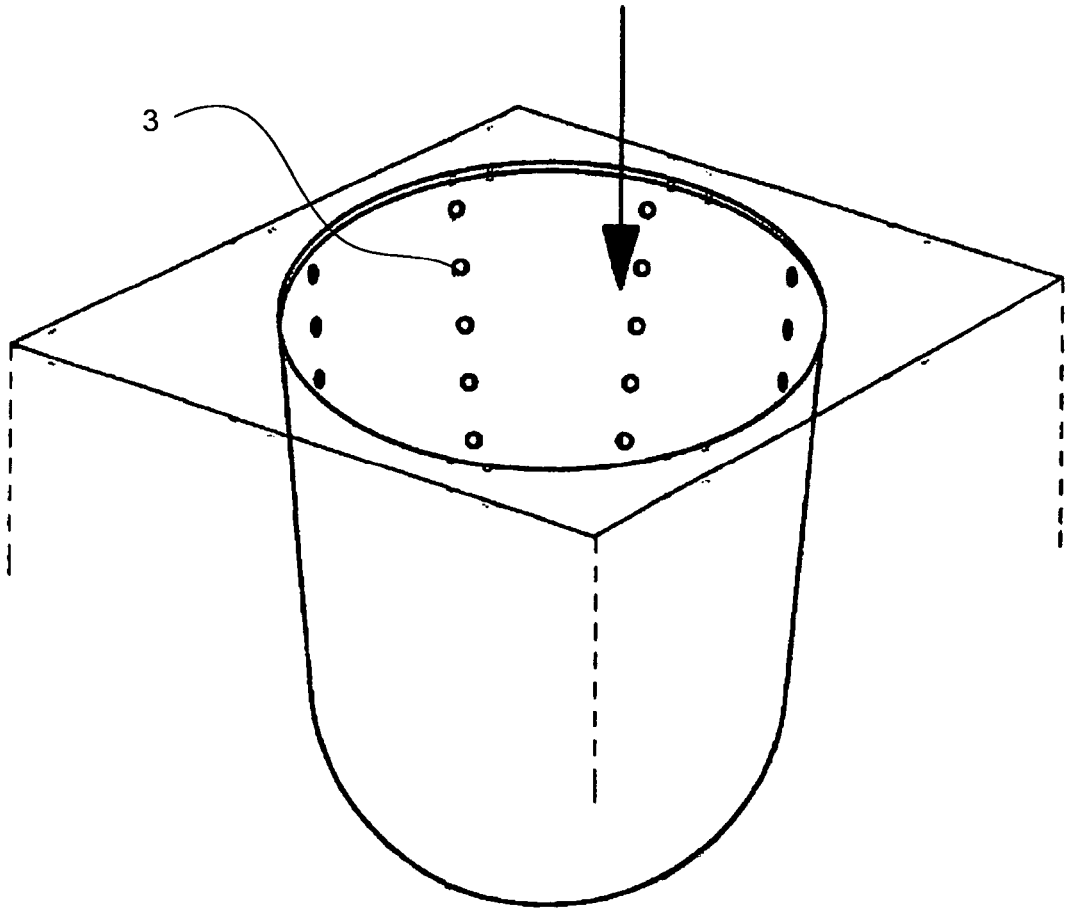
Figure 4:
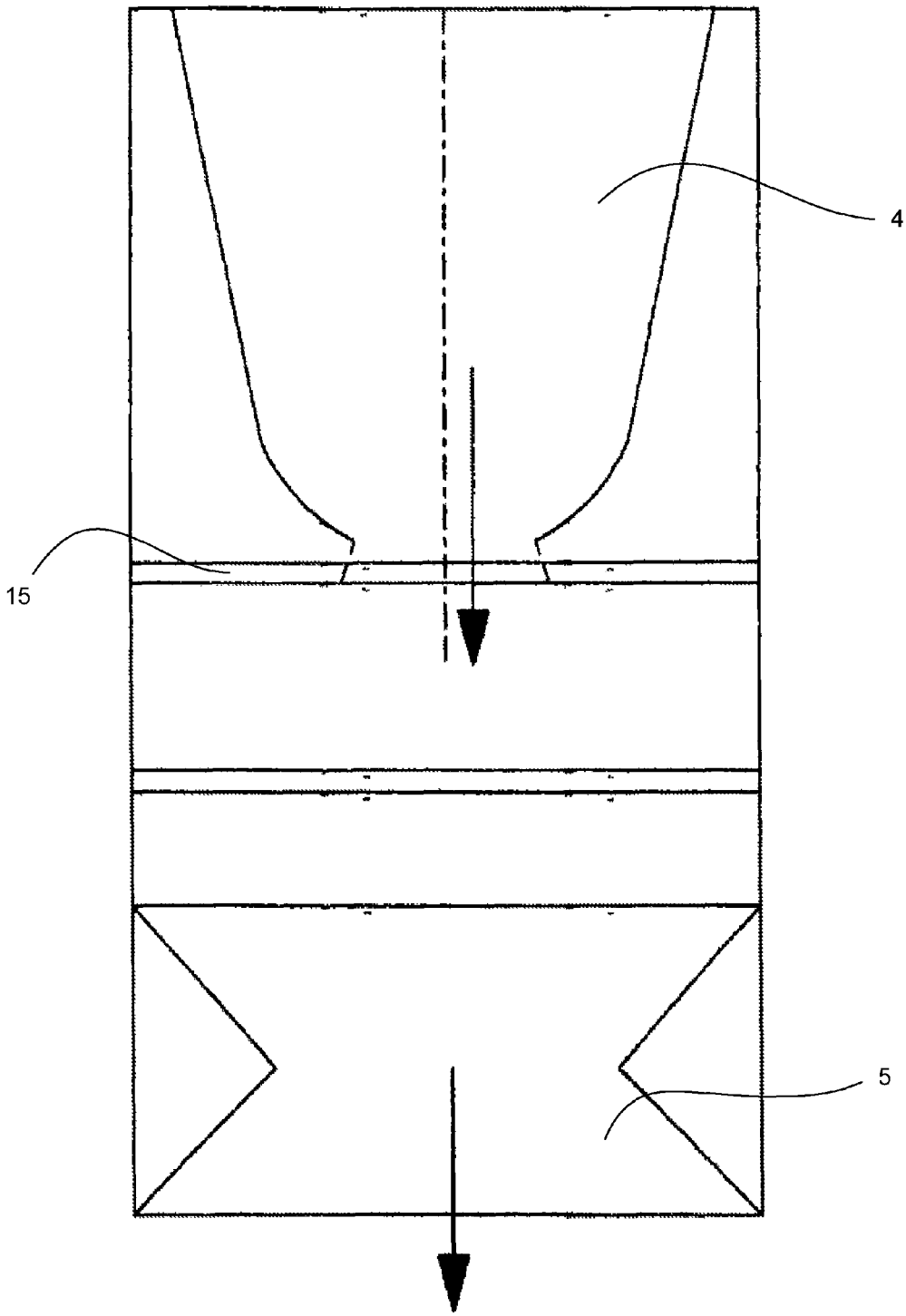
Figure 5:
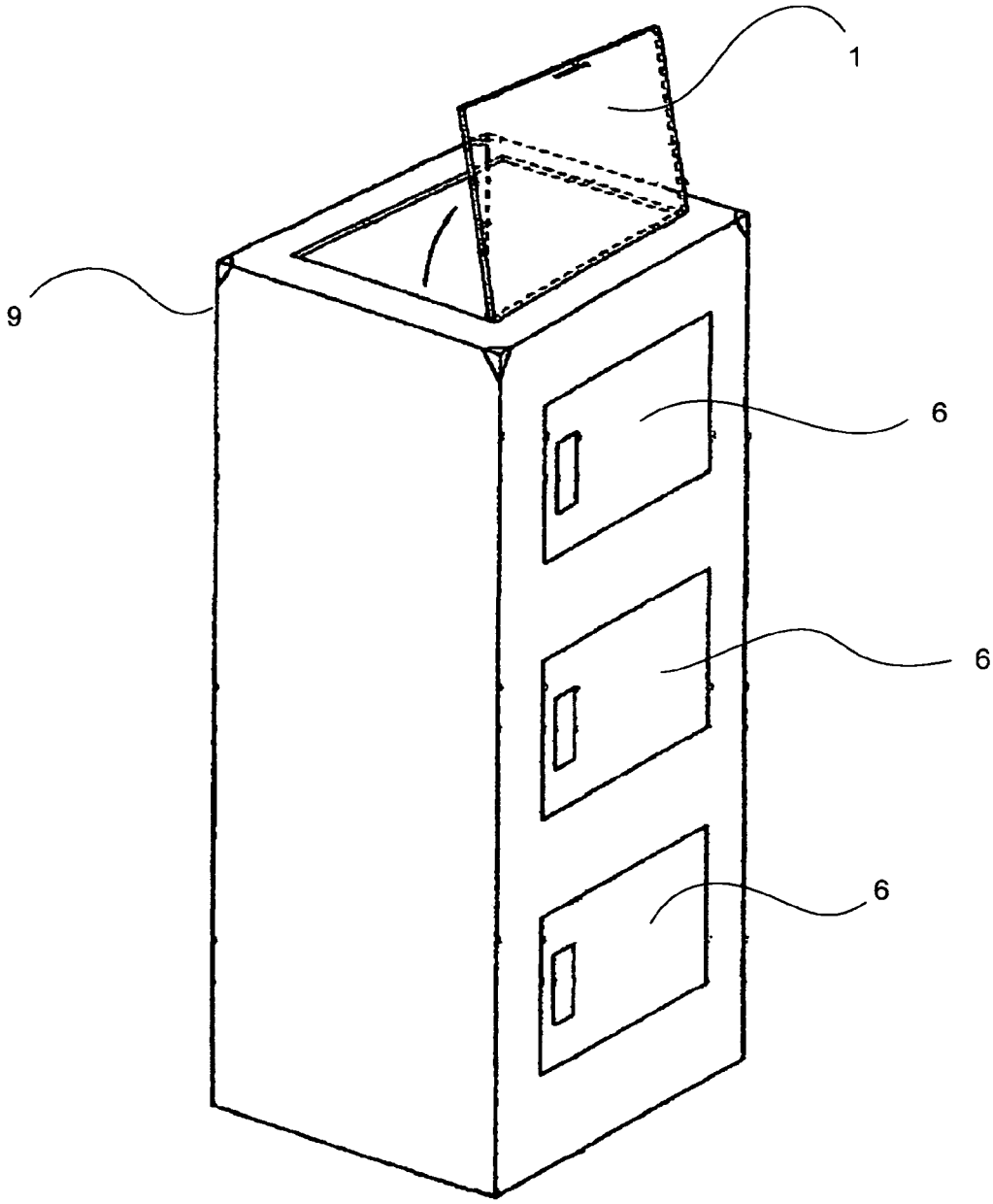
Figure 6:
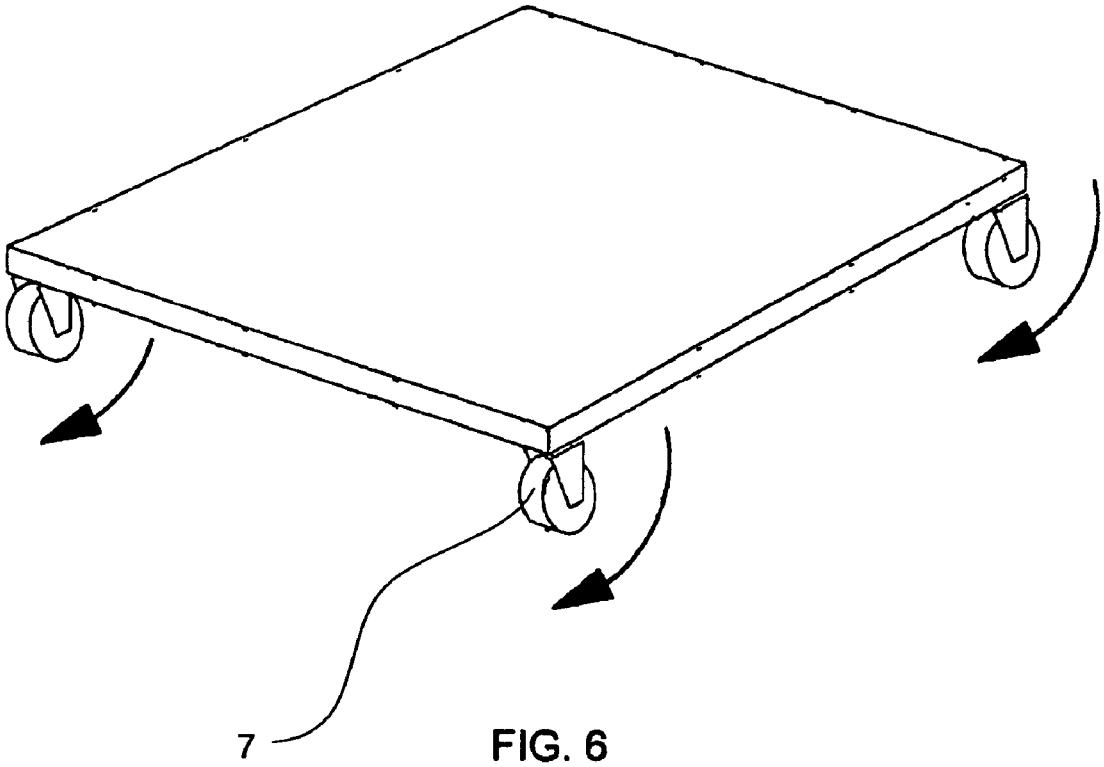

FIG. 1 The picture shows a door (1) at the top of the machine FIG. 2 shows where the pads (not shown) will go into the cleaning and disinfecting compartment (2) FIG. 3. That compartment is designed to tumble as a dryer (2) would tumble and has an action like a dry cleaner with a spray that sprays (3) disinfectant liquid on the pads as they tumble. The time period of the cleaning compartment is estimated at 3-4 minutes. The machine is designed to clean 3-5 pads at a time. FIG. 4 The machine is to be designed where the furniture pads are to automatically come down from the Compartment (4) and into the folding compartment (5) to be folded and compressed where the Pads will come out the bottom. FIG. 5 The machine has access doors (6) to each compartment. FIG. 6

Figure 7:
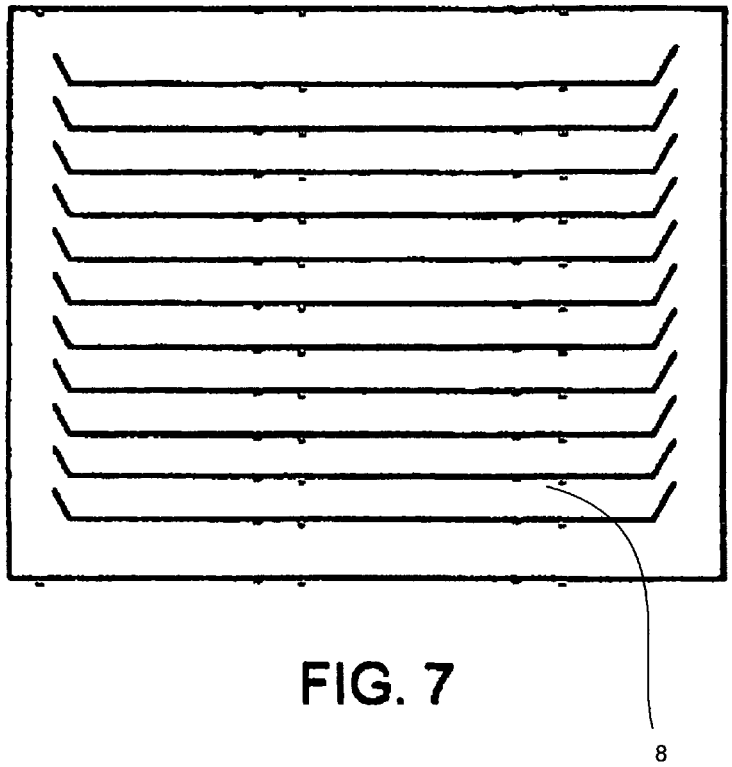
Figure 7A:
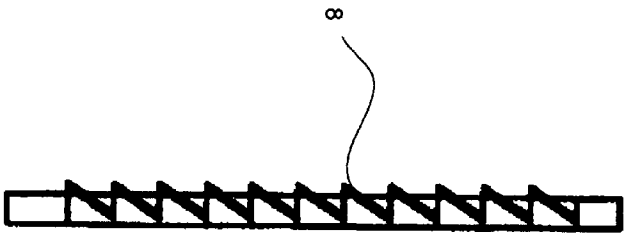
Figure 8:
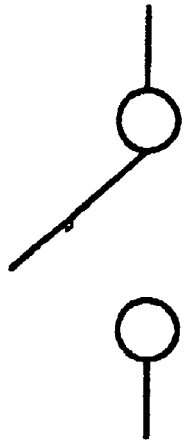
Figure 9:
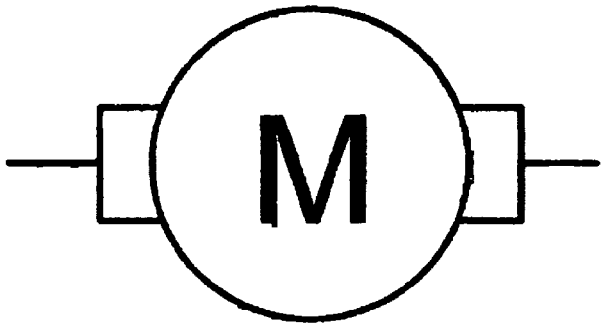
Figure 10:
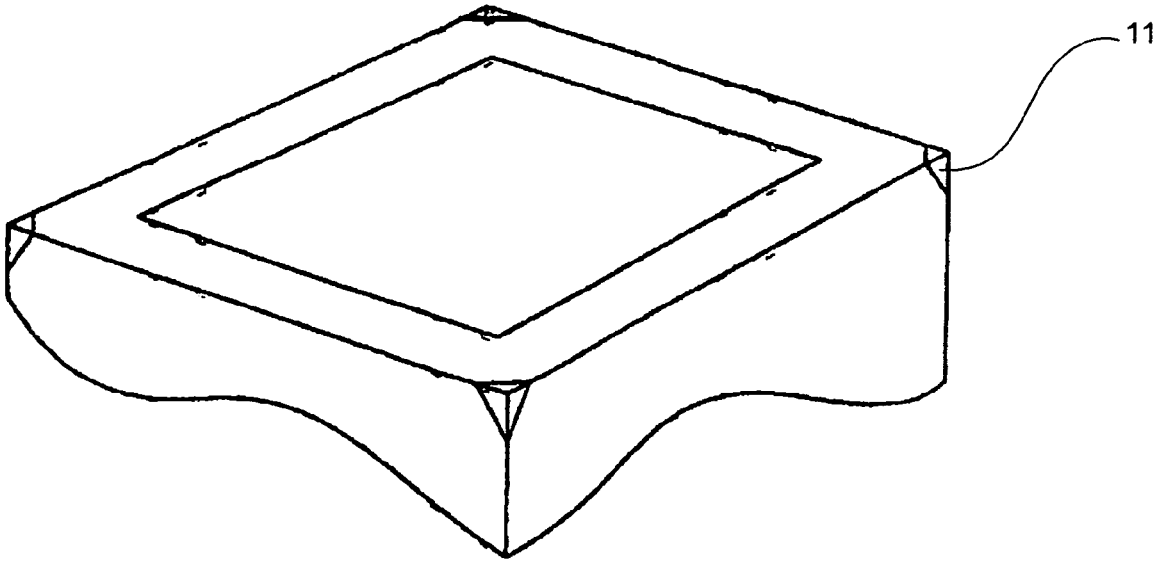

The machine is designed to be built with 4-way swivel rubber wheels (7). FIG. 7 The back of the machine has vents (8), FIG. 7A shows a side view of the vents (8). FIG. 8 On the back of the cleaning compartment (not shown), are automatic shut-off valves (9) in case of a jam of a pad, FIG. 9 is a motor, to operate the machine. The machine was designed to be built with the same type of supplies that it takes to build an upright washer and dryer. FIG. 10 shows that each corner of the machine has a hard plastic molding (11) for protection from bumping furniture into it. This machine is designed to be able to roll on and roll off of moving vans, and to be able to be rolled around where ever they may be needed.

If there are any questions from your architectural department with the invention of my project, feel free to discuss any new ideas or suggestions about it with me.

(This invention comes from 26 years of experience in the moving industry as a cross-country professional mover).

The Preamble

A machine comprising 2 compartments; one compartment used for sanitizing and disinfecting moving pads and the other compartment used to reduce the moving pads into a manageable size for reuse and storage.

The intent is to ensure a cleaner, germ-free, and healthier environment for movers and their family, Especially their children, because we know that children are usually more susceptible to diseases.

The Elements

A metal, rectangular shaped machine, upright stance, containing an up-lifting door to place the moving pads into the cleaning compartment to be sanitized and disinfected. The pads are then dropped by levers 15 into the folding compartment where they are neatly compressed into a manageable size for reuse and storage. The moving pads then exit the machine folded, sanitized, and disinfected. The machine has 4 wheels to make it portable and easily accessible. It should be noted that the machine contains small access doors on the left side of each compartment for easy access in the event of the pads becoming jammed.

Also, the machine has an automatic shut off Val and buzzer to indicate that there is a problem, if the machine jams.

Interconnections

The machine has 4 wheels for mobility and easy access that are attached to medal sides with plastic edges to protect objects, such as furniture, from damage. The medal is connected to the compressor; the compressor is connected to the folding area; which is connect to the lever from the cleaning and drying compartment; and the levers are attached to the medal sides; the medal sides are connected the cleaning and disinfecting area, where the disinfecting spray is sprayed onto the moving pads. Finally, the machine has a wide entry door where the moving pads are placed to begin the process.

BRIEF DESCRIPTION

FIG. 1 is a door at the top of the machine

FIG. 2 shows where the pads will go into the cleaning and disinfecting compartment FIG. 3 is the cleaning and disinfecting compartment FIG. 4 is the folding compartment FIG. 5 shows the access doors to each compartment FIG. 6 shows the 4-way swivel rubber wheels FIG. 7 shows the vents on the back of the machine FIG. 7A is a side view of the vents FIG. 8 is the switch for the automatic shut-off valves FIG. 9 is the motor FIG. 10 is the hard plastic molding on the corners

What is claimed is:

1. A sanitation and folding apparatus, for sanitizing and folding moving pads, comprising:

a portable upright rectangular frame, having castors;

a cleaning and drying compartment disposed on a top end of the frame, having a top access door for placing soiled pads into the first compartment, the cleaning and drying compartment having sprayers configuring to spray only non-water based cleaning solution, the cleaning and drying compartment having a drying mechanism;

a second folding compartment disposed directly inline and below the cleaning and drying compartment, wherein the apparatus is configured to automatically drop the pad into the folding compartment after cleaning the pads, the folding compartment configured to fold and compress the pads;

a lever disposed between the cleaning and drying compartment and the folding compartment configured to drop the pads from the cleaning and drying compartment into the folding compartment; and a compressor mounted inside the frame.

2. The sanitation and folding apparatus of claim 1, further comprising access doors on a same side of the frame, each compartment having an access door directly in line with one another.

3. The sanitation and folding apparatus of claim 1, further comprising a motor for operating the cleaning and drying and folding compartments.

* * * * *